US005809992A

United States Patent [19]

Moroi et al.

[11] Patent Number: 5,809,992

[45] Date of Patent: Sep. 22, 1998

[54] VISCOUS FLUID HEATER

[75] Inventors: Takahiro Moroi; Takashi Ban, both of Kariya, Japan

[73] Assignee: Kabushiki Kaisha Toyoda Jidoshokki Seisakusho, Kariya, Japan

[21] Appl. No.: 979,410

[22] Filed: Nov. 26, 1997

[51] Int. Cl.[6] ..... F24C 9/00

[52] U.S. Cl. ..... 126/247; 122/26

[58] Field of Search ..... 126/247; 122/26

[56] References Cited

U.S. PATENT DOCUMENTS

| | | | |
|---|---|---|---|
| 2,991,764 | 7/1961 | French | 122/26 |
| 4,480,592 | 11/1984 | Gocken | 122/26 |
| 4,993,377 | 2/1991 | Itakura | 123/142.1 R |
| 5,573,184 | 11/1996 | Martin | 237/12.3 R |

FOREIGN PATENT DOCUMENTS

| | | | |
|---|---|---|---|
| 0231357 | 12/1984 | Japan | 126/247 |

*Primary Examiner*—Carroll B. Dority
*Attorney, Agent, or Firm*—Brooks Haidt Haffner and Delahunty

[57] ABSTRACT

A viscous fluid type heater including a heating chamber and a heat exchange chamber, which is adjacent to the heating chamber. The heating chamber contains viscous fluid and a rotor. The heat exchange chamber is connected to a coolant circuit. The rotor is rotated by a drive shaft to shear the viscous fluid and produce heat in the heating chamber. The heat is transferred to the heat exchange chamber from the heating chamber to heat coolant passing through the heat exchange chamber and circulating in the fluid circuit. The heating chamber has a rear wall. The rotor has a rear surface facing the rear wall. Viscous fluid located between the wall and the rotor is sheared when the rotor rotates. A support shaft is supported by the rotor. The support shaft is eccentrically coupled to the drive shaft, which forces the viscous fluid located between the wall and the rotor to be periodically displaced. This prevents prolonged heating of any part of the fluid, which extends the life of the fluid.

22 Claims, 5 Drawing Sheets

VISCOUS FLUID HEATER

BACKGROUND OF THE INVENTION

1. Field of the Invention

The present invention relates to viscous fluid heaters having rotors that shear viscous fluid to generate heat, which is transferred to circulating coolant.

2. Description of the Related Art

Viscous fluid heaters, which are operated by drive force of automobile engines, have become widely used as auxiliary heat sources. Japanese Unexamined Patent Publication No. 2-246823 discloses a typical viscous fluid heater, which is incorporated into the heating system of an automobile.

The viscous fluid heater includes front and rear housings that define a heating chamber, A water jacket (heat exchange chamber) is defined outside the heating chamber. The front housing rotatably supports a drive shaft by means of a bearing. A rotor is fixed to one end of the drive shaft and is rotated integrally with the drive shaft in the heating chamber. Adjacent labyrinth grooves are formed in the front and rear surfaces of the rotor. Labyrinth grooves are also formed in the heating chamber walls opposing the front and rear surfaces of the rotor. Each labyrinth groove of the rotor surfaces is arranged between two labyrinth grooves of the opposing wall. Viscous fluid such as silicone oil fills the space between the heating chamber walls and the rotor surfaces.

The drive force of the engine rotates the drive shaft together with the rotor in the heating chamber. The rotation of the rotor shears the viscous fluid that fills the space between the heating chamber walls and the rotor surfaces to generate heat. Heat is transferred from the heated viscous fluid to the coolant circulating in the water jacket. The heated coolant is then sent to an exterior heater circuit to warm the passenger compartment.

In prior art viscous fluid heaters, most of the viscous fluid in the heating chamber ocuupies a slight gap provided between the rotor surfaces and the heating chamber walls. The rotating force produced by the engine is transmitted to the drive shaft of the viscous fluid heater. Thus, the rotating speed of the rotor is determined by the engine speed. When the angina speed is high, the shearing of the viscous fluid heats the fluid to a high temperature. High temperatures accelerate the deterioration of the viscous fluid. Deterioration of the viscous fluid decreases the viscosity of the fluid. If the viscosity of the fluid becomes low, the generated heat per rotation of the rotor decreases accordingly. Therefore, the heater may not produce the desired amount of heat.

SUMMARY OF THE INVENTION

Accordingly, it is an objective of the present invention to provide a viscous fluid heater that prolongs the life of the viscous fluid.

It is a further objective of the present invention to provide a viscous fluid heater having an improved heating efficiency.

To achieve the above objectives, the present invention provides a viscous fluid type heater. The heater includes a heating chamber containing viscous fluid. The heating chamber has a first wall. A rotor is located in the heating chamber. The rotor is rotated by a drive shaft to shear the viscous fluid and produce heat in the heating chamber. The rotor has a first surface facing the first wall. The first rotor surface and the first wall are spaced apart by a predetermined distance. Some of the viscous fluid occupies the space between the first rotor surface and the first wall and is sheared when the rotor is rotated. A heat exchange chamber is located close to the heating chamber. The heat exchange chamber communicates with a coolant circuit. Heat generated by the fluid shearing is transmitted from the heating chamber to the coolant in the heat exchange chamber to heat the coolant in the fluid circuit. A support shaft supports the rotor. The support shaft is eccentrically coupled to the drive shaft.

Other aspects and advantages of the invention will become apparent from the following description, taken in conjunction with the accompanying drawings, illustrating by way of example the principals of the invention.

BRIEF DESCRIPTION OF THE DRAWINGS

The features of the present invention that are believed to be novel are set forth with particularly in the appended claims. The invention, together with objects and advantages thereof, may best be understood by reference to the following description of the presently preferred embodiments together with the accompanying drawings in which:

FIG. 6(*b*) is an enlarged view showing a portion of the viscous fluid heater of FIG. 6(*a*);

DETAILED DESCRIPTION OF THE PREFERRED EMBODIMENTS

A first embodiment of a viscous fluid heater according to the present invention, which Is incorporated in a heater of an automobile, will now be described with reference to FIGS. 1 to 3.

Figure 1:
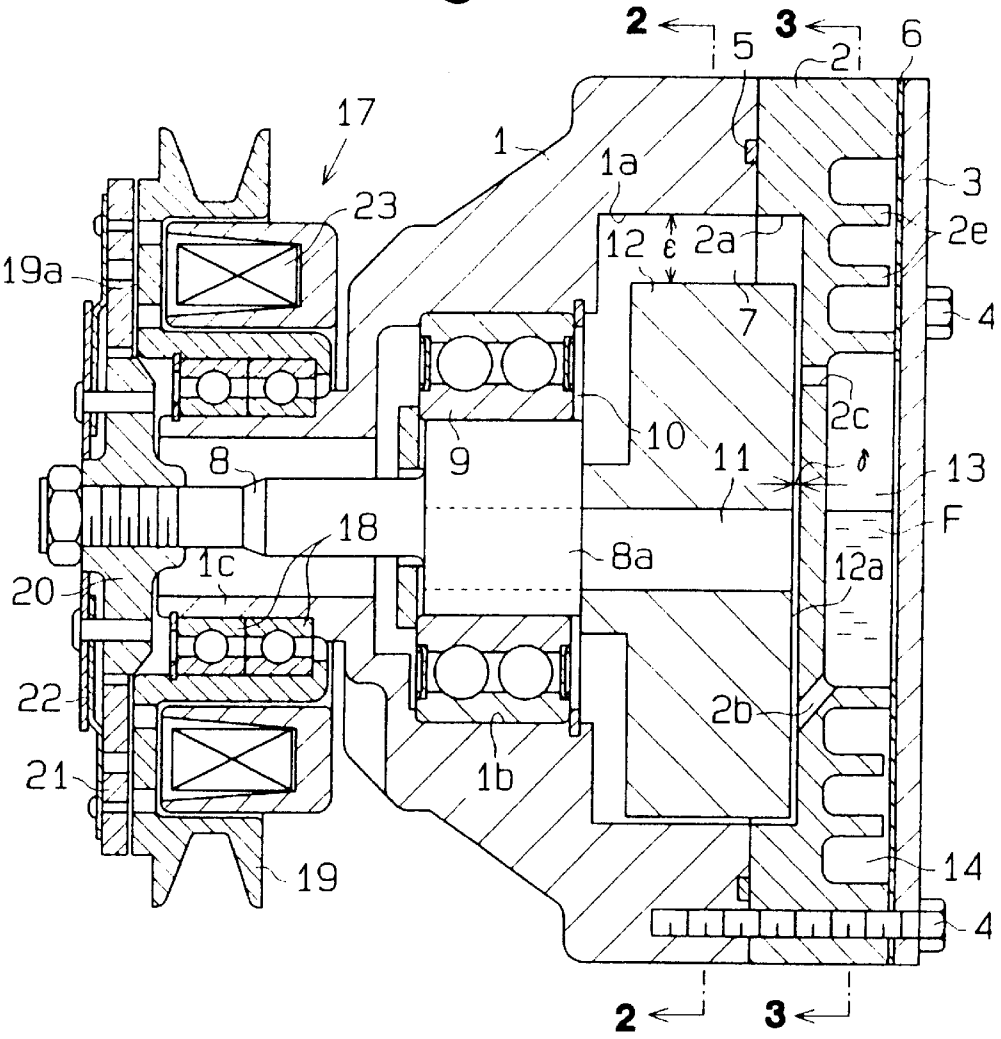
FIG. 1 is a cross-sectional view showing a first embodiment of a viscous fluid heater according to the present invention.
Figure 2:
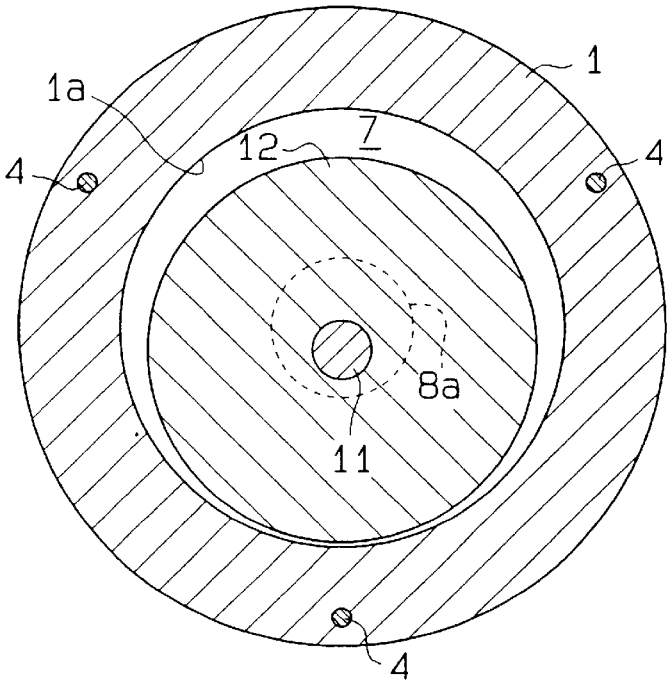
FIG. 2 is a cross-sectional view taken along the line 2—2 in FIG. 1.

As shown in FIG. 1, a plurality of bolts 4 (three in this embodiment) fasten a front housing 1, a rear housing 2, and a rear plate 3 to one another. An O-ring 5 seals the gap between the front housing 1 and the rear housing 2, while a gasket 6 seals the gap between the rear housing 2 and the rear plate 3. The rear housing 2 is formed from a material having superior heat conductivity, such as aluminum or aluminum alloy. The rear plate 3 is formed from a material such as stainless steel, the heat conductivity of which is inferior to that of the rear housing 2.

A bore 1*a* is provided in the rear side of the front housing 1. A bore 2*a*, which is connected with the bore 1*a*, is provided in the front side of the rear housing 2. The bores 1*a*, 2*a* define a heating chamber 7. A socket 1*b*, which is communicated with the bore 1*a*, is provided in the front housing 1. The socket 1*b* and the heating chamber 7 are coaxial. A drive shaft 8 is received in the socket 1*b* and is rotatably supported by a bearing 9. The bearing 9 is an angular bearing and is provided with lip seals. The lip seals prevent the viscous fluid in the heating chamber 7 from leaking out of the heating chamber 7 through the space between the inner race and outer race of the bearing 9. One end of the bearing 9 abuts against the front housing 1 while the other end of the bearing 9 abuts against a stopper ring 10. Thus, the bearing 9 is hold at a predetermined position. A large diameter portion Sa is defined at the rear end of the drive shaft 8. The bearing 9 supports the large diameter portion 8*a* of the drive shaft 8.

An eccentric shaft 11 is fixed to the large diameter portion 8*a* of the drive shaft 8 extending into the heating chamber 7. The axis of the eccentric shaft 11 is eccentric to the drive shaft 8. A cylindrical rotor 12 is fitted to the eccentric shaft 11 so that the rotor 12 and the eccentric shaft 11 are coaxial. The rotor 12 is fixed so that it does not rotate relative to the eccentric shaft 11.

The rotor 12 includes a rear surface 12*a*, which faces the rear housing 2. The rotor 12 is arranged on the eccentric shaft 11 so that a first gap $\delta$ of 0.1 mm to 0.5 mm is provided between the rear surface 12*a* and the opposing wall of the rear housing 2. The range of the first gap $\delta$ has been experimentally based on efficiency. A variable second gap $\epsilon$ is provided between the peripheral surface of the rotor 12 and the peripheral wall of the heating chamber 7 in the radial direction of the heating chamber 7. The minimum distance of the second gap $\epsilon$ is uniform throughout the heating chamber 7 and is determined at a value that efficiently shears the viscous fluid included in the second gap $\epsilon$.

A reservoir 13 and an annular water jacket 14 are defined in the rear housing 2 in front of the rear plate 3 at positions corresponding to the heating chamber 7. The water jacket 14 defines a heat exchange chamber that is adjacent to the heating chamber 7. The heating chamber 7 is communicated with the reservoir 13 through passages 2*b*, 2*c*, which extend through the rear housing 2. A certain amount of silicone oil F, which serves as the viscous fluid, is provided in the heating chamber 7 and the reservoir 13. The passage 2*b* connects the lower portion of the reservoir 13 with the heating chamber 7, while the passage 2*c* connects the upper portion of the reservoir 13 with the heating chamber 7. Silicone oil F is reserved in the reservoir 13, with the surface of the silicone oil F located below the passage 2*c*.

The rear housing 2 includes a partition 2*d* (FIG. 3) and two arcuate fins 2*e*. The partition 2*d* extends radially in the water jacket 14. Each fin 2*e* projects toward the gasket 6 and extends circumferentially about the reservoir 13 in the water jacket 14. The partition 2*d* is in contact with the gasket 6, while each fin 2*e* is spaced from the gasket 6.

Figure 3:
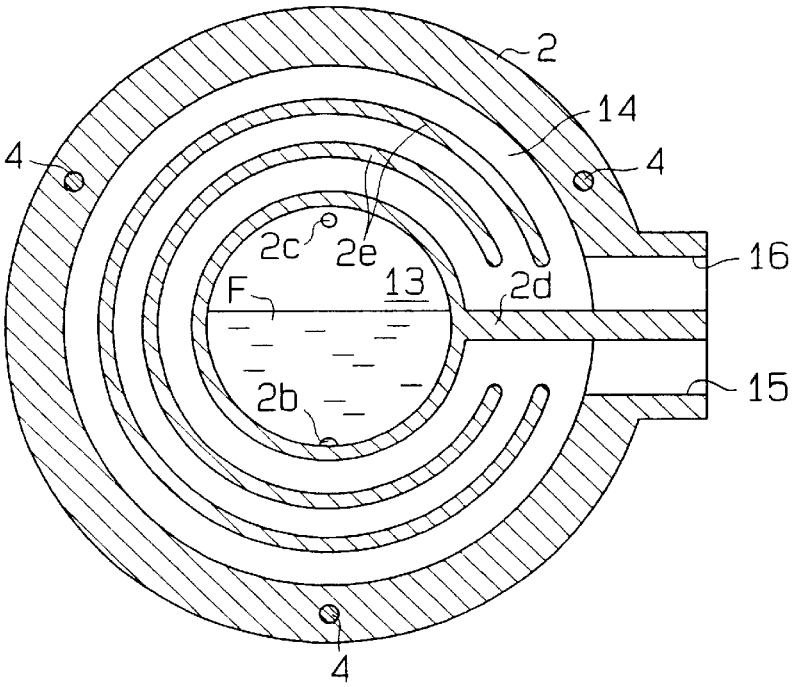
FIG. 3 is a cross-sectional view taken along the line. 3—3 in FIG. 1.

As shown in FIG. 3, an inlet 15 and an outlet 16 are provided in the rear housing 2. Coolant flows through the inlet 14 into the water jacket 14 from a heater circuit (not shown) of an automobile. The coolant in the water jacket 14 returns to the heater circuit through the outlet 16. The partition 2*d* separates the inlet 15 from the outlet 16. Thus, the coolant that flown into the water jacket 14 through the inlet 15 is guided by the fins 2*e* and is circulated through the water jacket 14 in a clockwise direction, as viewed in FIG. 3. After circulating through the water jacket 14, the coolant flows out of the water jacket 14 though the outlet 16.

A cylindrical support 1*c* projects from the front housing 1. An electromagnetic clutch 17 is arranged in the vicinity of the front ends of the drive shaft 9 and tho cylindrical support 1*c*. The electromagnetic clutch 17 includes a pulley 19 and a disc-like clutch plate 21. The pulley 19 is rotatably supported on the support 1*c* by an angular bearing. A support ring 20 is fastened to the front end of the drive shaft 8. The clutch plate 21 is fitted on the support ring 20. Relative sliding in the axial direction is permitted between the clutch plate 21 and the support ring 20. A loaf spring 22 is arranged in front of the clutch plate 21 with its central portion fixed to the support ring 20. The peripheral portion of the leaf spring 22 (upper and lower portions, as viewed in FIG. 1) is fastened to the peripheral portion of the clutch plate 21 by rivets, or similar fasteners. The rear surface of the clutch plate 21 faces the front surface 19*a* of the pulley 19. The front surface functions as another clutch plate. The pulley 19 is operably connected to an automobile engine (not shown) by a belt (not shown). A annular solenoid coil 23 is supported by the front housing 1 to apply electromagnetic force (attraction force) to the clutch plate 21 through the front surface 19*a* of the pulley 19.

When the engine is driven with the viscous fluid heater connected to the exterior heater circuit, the rotational force of the engine is transmitted to the pulley 19. The solenoid coil 23 of the electromagnetic clutch 17 is then excited to move the clutch plate 21 against the force of the leaf spring 22. This engages the clutch plate 21 with the front surface 19*a* of the pulley 19. The engagement transmits the rotation of the pulley 19 to the drive shaft 8 through the clutch plate 21 and the support ring 20. The rotational speed of the drive shaft 8 is varied in correspondence with the speed of the exterior drive source, or the engine.

Figure 4:
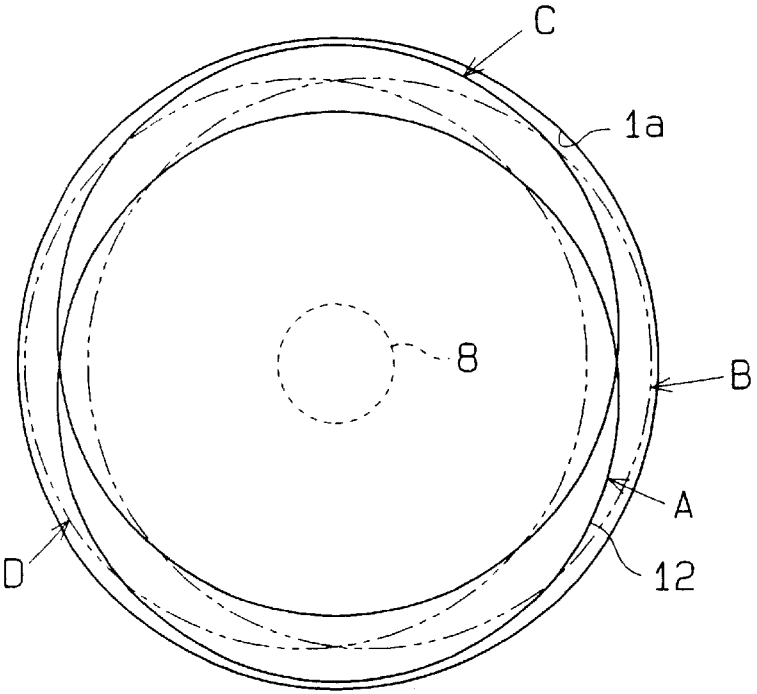
FIG. 4 is an explanatory diagram showing the movement of the rotor.

Rotation of the drive shaft 8 orbits the eccentric shaft 11 about the axis of the drive shaft 8. The rotor 12 orbits integrally with the eccentric shaft 11 in the heating chamber 7. In this state, as shown in FIG. 4, the rotor 12 moves from position A to position B, then to position C, and finally to position D. The orbiting movement of the rotor 12 shears the silicone oil F, which is included between the rear surface 12*a* of the rotor and the rear wall of the heating chamber 7. This produces fluid friction and heats the silicone oil F.

Heat exchange takes place between the heated silicone oil F and the coolant circulating through the water jacket 14. The heated coolant is then returned to the heater circuit (not shown) to warm the passenger compartment. The water jacket 14 is located outside the heating chamber 7 adjacent to the rear surface 12*a* of the rotor 12. In other words, the water jacket 14 is located near the heat source. This efficiently transfers the heat generated in the heating chamber to the water jacket 14. Thus, the heat exchange efficiency between the silicone oil F in the heating chamber and the coolant circulating through the water jacket 14 is improved.

Viscous fluid occupies the space provided in the heating chamber 7 to allow orbiting of the rotor 12. This space includes the first gap $\delta$ and the second gap $\epsilon$. The first gap $\delta$ is between the rear surface 12*a* of the rotor 12 and the rear wall of the heating chamber 7. The variable second gap $\epsilon$ is between the peripheral surface of the rotor 12 and the peripheral wall of the heating chamber 7. The second gap $\epsilon$ is connected with the first gap $\delta$. As the rotor 12 orbits, the second gap ϵ varies. This moves the silicone oil F in the second gap ϵ in correspondence with the orbiting of the rotor 12. The orbiting of the rotor 12 also moves the silicone oil F out of the first gap δ and into the second gap ϵ. In this manner, the silicone oil F in the first gap δ is continuously replaced by silicone oil F from the second gap ϵ. Accordingly, continuous shearing of the silicone oil F over a long period of time is avoided. Therefore, the same silicone oil F is not sheared constantly and kept at a high temperature for a long period of time, even if the engine runs continuously at a high speed. This prevents rapid deterioration of the silicone oil F.

When the rotor 12 orbits about the drive shaft 8 in the heating chamber 7, the silicone oil F applies a reaction force to the rotor 12 in a direction opposite to the orbiting direction of the rotor 12. However, since the rotor 12 is fixed to the eccentric shaft 11, relative rotation between the rotor 12 and the eccentric shaft 11 is prohibited. As a result, the force applied to the rotor 12 by the rotation of the drive shaft 8 results in additional fluid friction in the silicone oil F.

The fine 2*e* guide the coolant along a predetermined circulating route in the water jacket 14. This eliminates problems such as insufficient circulation and stationary coolant in the water jacket 14. Accordingly, heat exchange takes place efficiently between the heating chamber 7 and the coolant circulating through the water jacket 14.

Each fin 2*e* projects into the water jacket 14 in the vicinity of the heating chamber 7. This increases the heat surface transfer area between the coolant, which circulates through the water jacket 14, and the walls adjacent to the heating chamber 7. Thus, the fins 2*e* further improve the heat exchange efficiency. Furthermore, each fin 2*e* is spaced from the opposing rear plate 3. This prevents heat from being conducted directly from the fins 2*e* to the rear plate 3, which would then transfer the heat externally. Thus, the efficiency of heat exchange between the heating chamber 7 and the coolant circulating in the water jacket 14 is further improved.

The reservoir 13 reserves silicone oil P. During orbiting of the rotor 12, the silicone oil F in the heating chamber 7 flows into the reservoir 13 through the passage 2*c*, while the silicone oil F in the reservoir 13 flows into the heating chamber 7 through the passage 2*b*. Thus, heat is not generated within the same silicone oil F for a long period of time. This prolongs the life of silicone oil F.

The rear housing 2 is formed of a material having superior heat conductivity. This efficiently conducts heat generated in the heating chamber 7 to the coolant circulating in the water jacket 14. Furthermore, the rear plate 3 is formed of a material having low heat conductivity. This hinders conduction of heat from the water jacket 14 through the rear plate 3.

A further embodiment according to the present invention will now be described with reference to FIG. 5.

In this embodiment, the silicone oil F (viscous fluid) is sheared in the heating chamber 7 by both the front and rear surfaces of the rotor 24.

The rotor 24 includes a large diameter portion 24*a* and a small diameter portion 24*d*. The large diameter portion 24*a* is provided on the front side of the rotor 24, while the small diameter portion 24*d* is provided on the rear side of the rotor 24. A rear surface 24*b* is defined on the rear end of the large diameter portion 24*a*, while a front surface 24*c* is defined on the front and of the large diameter portion 24*a*. A large bore 7*a* is provided in the heating chamber 7 in correspondence with the large diameter portion of the rotor 24. A wall surface 7*c* is defined in the large bore 7*a* facing the front surface 24*c* of the small diameter portion 24*d*. The heating chamber 7 also includes a small bore 7*b* in correspondence with the small diameter portion 24*d* of the rotor 24. The diameter of the small bore 7*b* permits enough space to permit the orbiting of the rotor 24, while also providing maximum area for the wall surface 7*c*.

A gap ζ is provided between the front surface 24*c* of the small diameter portion 24*d* and the opposing wall surface 7*c*, while a gap δ is provided between the rear surface 24*b* of the large diameter portion 24*a* and the opposing wall of the rear housing 2. The dimension of gap δ is the same an that of the first embodiment. In the same manner as the first embodiment, a variable gap ϵ is provided between the large diameter portion 24*d* of the rotor 24 and the radially opposing peripheral wall of the large bore 7*a*. A further variable gap η is provided between the small diameter portion 24*d* of the rotor 24 and the radially opposing peripheral wall the small bore 7*b*. The dimensions of gap ϵ and gap η (when minimum) are equal to each other.

Like the first embodiment, in this embodiment, the rotor 24 orbits in the heating chamber 7 during rotation of the drive shaft 8. This shears and heats the silicone oil F located between the rear surface 24*b* of the large diameter portion and the opposing wall of the rear housing 2 and the silicone oil F between the front surface 24*c* of the small diameter portion 24*d* and the wall surface 7*c* of the heating chamber 7. Simultaneously, the orbiting of the rotor 24 moves the silicone oil F in the gaps ϵ and η and circulates the silicone oil F. Thus, the same silicone oil F is not sheared for a significant length of time. This prevents deterioration of the silicone oil F.

In this embodiment, the silicone oil F between the front surface 24*c* of the rotor 24 and the opposing wall 7*c* of the heating chamber 7 is also sheared to produce heat. This improves the heating output of tho viscous fluid heater per rotation of the drive shaft 8. Furthermore, the area of the rotor 12 that contributes to heating is increased without enlarging the rotor, and the volume of the rotor is smaller. The provides a lighter rotor and reduces power consumption.

A third embodiment according to the present invention will now be described with reference to FIGS. 6(*a*), 6(*b*).

In the third embodiment, the axial lengths of the rotor 12 and the heating chamber 7 are shorter than that of the above embodiments. Furthermore, a flap 25, functioning as a valve, is provided in the reservoir 13 to selectively open and close the passage 2*b*.

The flap 25 is formed from a material such as a bimetal or a shape memory alloy. When the temperature of the heating chamber 7 exceeds a predetermined value, the flap 25 closes the passage 2*b*. The flap 25 opens the passage 2*b* when the temperature of the heating chamber 7 is lower than the predetermined value. The predetermined temperature is one at which the silicone oil F rapidly deteriorates. The temperature at which the flap 25 starts to deform is not equal to but is lower than the predetermined temperature. The temperature at which the flap 25 closes is selected in consideration of the difference between the temperature in the heating chamber 7 and the temperature at the location of the flap 25.

Figure 6B:
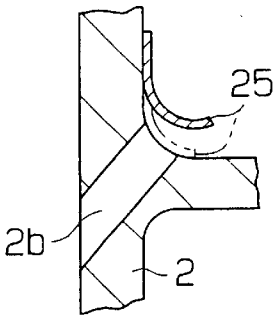
FIG. 6(*a*) is a partial cross-sectional view showing a third embodiment or a viscous fluid heater according to the present invention.
Figure 6A:
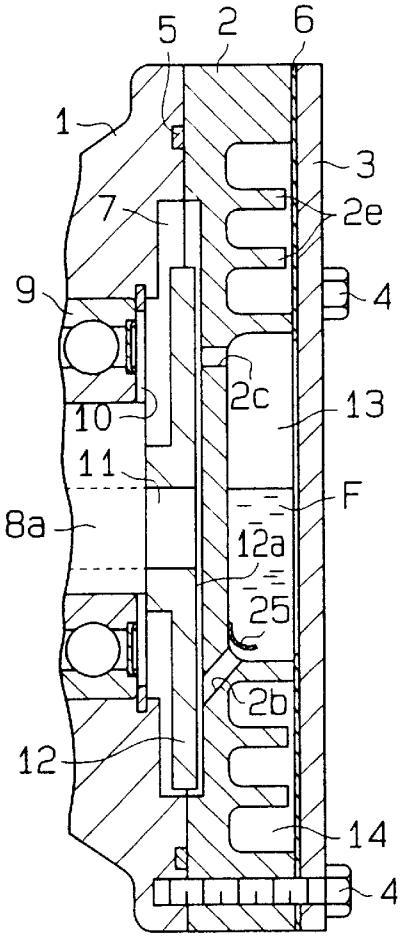

When the temperature of the heating chamber 7 is lower than the predetermined value,, the flap 25 is maintained at an open state, as shown by the solid lines in FIGS. 6(*a*) and 6(*b*). This permits the silicone oil F in the reservoir 13 to flow into the heating chamber 7. As a result, the silicone oil F circulates between the heating chamber 7 and the reservoir 13. However, when the temperature of the heating chamber 7 exceeds the predetermined value, the flap 25 deforms to a closed state, as shown by the dotted lines in FIG. 6(*b*). This hinders the flow of the silicone oil F from the reservoir 13 to the heating chamber 7. When the passage 2*b* is closed, continuous rotation of the rotor 12 causes the silicone oil F to continue returning to the reservoir 13 through the passage 2*c*. This decreases the amount of the silicone oil F in the heating chamber 7 and reduces the heating of the silicone oil F. Consequently, overheating of the silicone oil F is prevented. Therefore, the life of the silicone oil F is prolonged in comparison with the first two embodiments.

It should be apparent to those skilled in the art that the present invention may be embodied in many other specific forms without departing from the spirit or scope of the invention. Particularly, the present invention may also be modified as described below.

Figure 7:
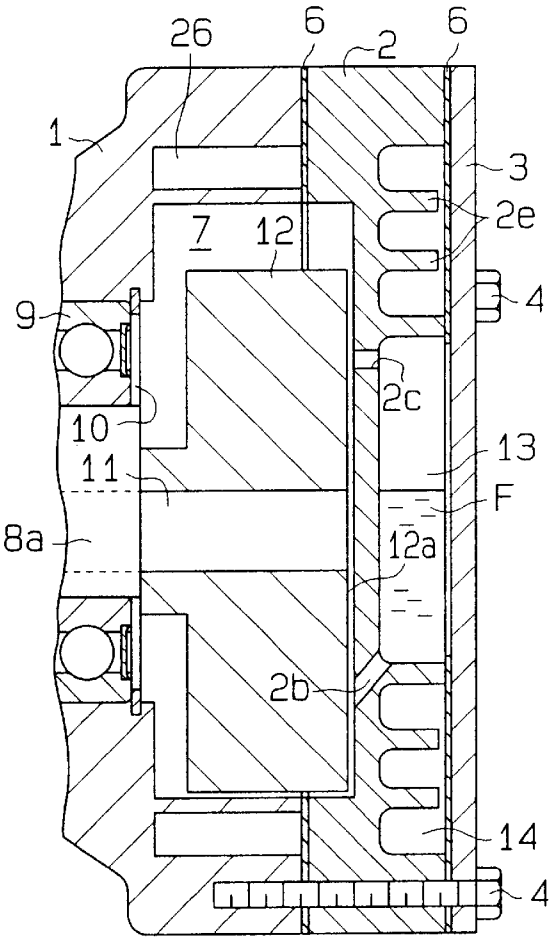
FIG. 7 is a partial cross-sectional view showing a water jacket employed in a further embodiment of a viscous fluid heater according to the present invention.
Figure 8:
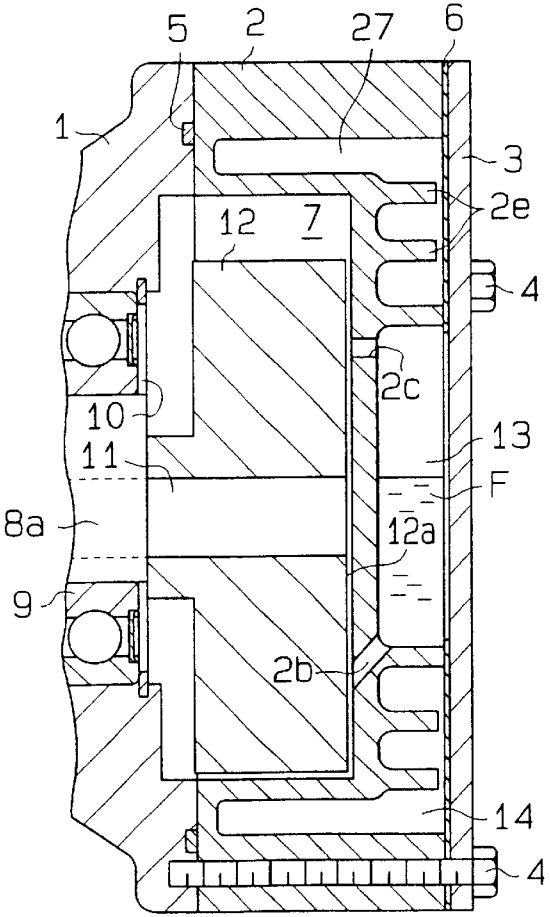
FIG. 8 is a partial cross-sectional view showing a water jacket employed in a further embodiment of a viscous fluid heater according to the present invention.

FIGS. 7 and 8 each show variations of the water jacket in further embodiments. In the embodiment of FIG. 7, an additional water jacket 26 is defined in the front housing 1 by a generally annular groove, which is opened toward the rear housing 2. A further gasket 6 is arranged between the front housing 1 and the rear housing 2 to prevent leakage of coolant from the water jacket 26. The water jacket 26 is provided with an inlet and an outlet (neither are shown). Coolant from the heater circuit (not shown) is distributed between the two water jackets 14, 26. The coolant streams discharged from the water jackets 14, 26 are joined when returning to the heater circuit.

In the embodiment shown in FIG. 8, most of the heating chamber 7 is defined in the rear housing 2. A generally annular groove 27 extends around the heating chamber 7 and communicates with the water jacket 14.

The viscous fluid heaters of the embodiments shown in FIGS. 7 and 8 both have a higher heat exchange efficiency in comparison with a viscous fluid heater that has a water jacket provided only in the wall of the heating chamber 7 adjacent to the rear surface 12*a* of the rotor 12.

Figure 9A:
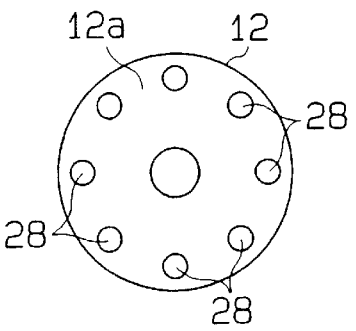
FIGS. 9(*a*), 9(*b*), and 9(*c*) are front views, each showing a pattern provided on the rotor to increase the shearing force of the rotor in a viscous fluid heater according to further embodiments of the present invention.
Figure 9B:
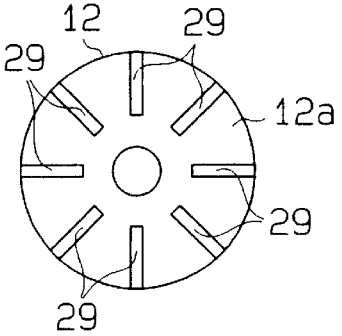
Figure 9C:
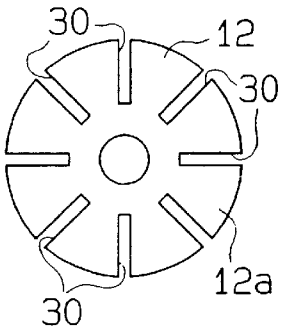

FIGS. 9(*a*), 9(*b*), and 9(*c*) each show shearing force enhancing pattern that is employed in a further embodiment. Each pattern is formed by recessed areas in the rear surface 12*a* of the rotor 12 or the rear surface 24*b* of the rotor 24 to improve the shearing force applied to the viscous fluid. The dimension of the gap a between the rear surface 12*a* or 24*b* and the opposing wall of the heating chamber 7 is varied by each recessed area during orbiting of the rotor 12 or 24. For example, FIG. 9(*a*) shows a plurality of circular bores (or recesses) 28 that are formed in the rear surface 12*a*. FIG. 9(*b*) shows a plurality of grooves 29 that extend radially in the rear surface 12*a* of the rotor 12. FIG. 9(*c*) shows a plurality of radial slits 30 that extend axially through the rotor 12. It is preferable that the corners formed by the bores 28, the grooves 29, and the slits 30 not be chamfered.

The shearing force enhancing pattern, on the rear surface 12*a* reduces the effective heating area of the rear surface 12*a*. However, the dimension of the gap between the rear surface 12*a* of the rotor 12 and the opposing wall of the heating chamber 7 changes as the rotor 12 orbits and rotates. During orbiting of the rotor 12, as the dimension of the gap increases, that is, as the bores 28, grooves 29, or slits 30 come to face the opposing wall of the heating chamber 7, the shearing force of the rotor 12 is increased. However, if the recessed areas dominate a large portion of the rear surface 12*a*, the effective heating area will be insufficient. This would decrease the amount of heat generated by the viscous fluid heater. Accordingly, it is preferable that the total recessed areas (slits, holes, etc.) not exceed 20 percent of the area of the rear surface 12*a*.

Furthermore, gas contained in the viscous fluid is collected by the bores 28, the grooves 29, or the slits 30. This eliminates most of the gas in the gap between the rear surface 12*a* and the opposing wall of the rear housing 2 when generating heat. Consequently, the shearing force is applied more efficiently to the viscous fluid.

The machining of the bores 28 is more simple than the machining of the grooves 29 or the slits 30. Furthermore, the bores 28 need not be circular and may take arbitrary shapes. For example, the bore 28 may be polygonal, triangular, rectangular, or oval. Additionally, the bores 28 may be extended through the rotor 12.

The grooves 29 and the slits 30 increase the places at which the gap between the rear surface 12*a* and the opposing wall of the heating chamber 7 varies when the rotor 12 orbits. Furthermore, if the amount of gas collected in the grooves 29 or the slits 30 becomes large, the gas escapes into the heating chamber 7 from the peripheral surface of the rotor 12. Therefore, the gas does not return to the gap between the rear surface 12*a* of the rotor 12 and the opposing wall of the heating chamber 7. As a result, the shearing effect is not degraded.

In the shearing force (enhancing pattern, the bores 28, the grooves 29, and the slits 30 may be combined with one another.

Figure 5:
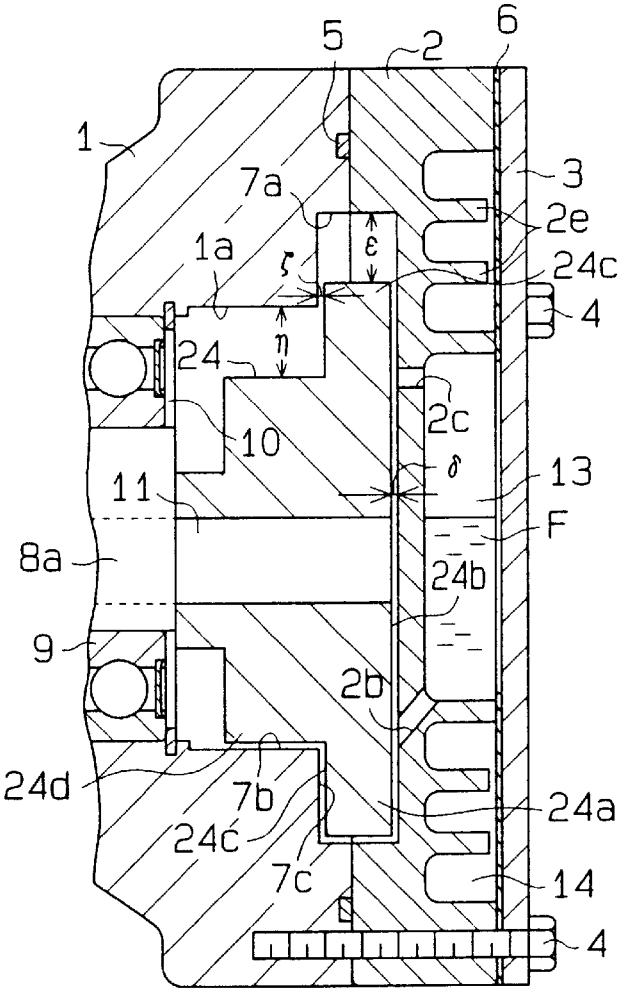
FIG. 5 is a partial cross-sectional view showing a second embodiment of a viscous fluid heater according to the present invention.

When the viscous fluid is sheared at opposite sides of the rotor 24, as in the embodiment of FIG. 5, the bores 28, the grooves 29, or the slits 30 may be provided on surfaces 24*b*, 24*c* of the rotor 24. A shearing force enhancing pattern provided on the front surface 24*c* has the same advantages as one provided on the rear surface 24*b*.

Instead of applying the shearing force enhancing pattern to the rear surfaces 12*a*, 24*b* or the front surface 24*c*, the pattern may be provided in the walls of the heating chamber 7 facing the surfaced 12*a*, 24*b*, or 24*c*. A shearing force enhancing pattern provided on the walls of the heating chamber 7 has the same advantages as one provided on the rotors 12, 24. Also, the shearing force enhancing pattern may be provided on both the rotor 12, 24 and the walls of the heating chamber 7.

The shearing force enhancing pattern may be constituted by projections that project from the surfaces of the rotors 12, 24 or from the walls of the heating chamber 7 opposing the rotor surfaces. The height of each projection (the projecting amount) must be smaller than the optimum distance between the rotor 12, 24 and the opposing wall of the heating chamber 7 for shearing the viscous fluid effectively when there are no projections. Thus, the projections need to be machined accurately. Although the machining of the projections is complicated, the added heating efficiency of the projections is higher than that of the bores 28, the grooves 29, or the slits 30.

Figure 10A:
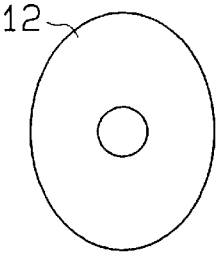
FIGS. 10(*a*) and 10(*b*) are front views each showing a rotor employed in a viscous fluid heater according to further embodiments of the present invention.
Figure 10B:
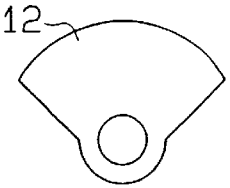

FIGS. 10(*a*) and 10(*b*) each show variations of the rotor 12 that are employed in further embodiments. The shape of the rotor 12, 24 is not restricted. For example, as shown in FIG. 10(*a*), the rotor 12 may be oval, or as shown in FIG. 10(*b*), the rotor 12 may be arcuate. The rotor 12, 24 may also be polygonal like a triangle or a rectangle. An oval or arcuate form decreases the volume of the rotor 12, 24 with respect to the volume of the heating chamber 7. This increases the proportion of the viscous fluid in the heating chamber 7 that does not undergo shearing with respect to the proportion of the viscous fluid that undergoes shearing. Accordingly, the life of the viscous fluid is prolonged.

The reservoir 13 may be eliminated from the structure of the viscous fluid heater. The space provided to permit orbiting of the rotor 12, 24 may be used to accommodate a relatively large amount of viscous fluid. Thus, even without the reservoir 13, the life of the viscous fluid may be prolonged when compared to prior art viscous fluid heaters. Furthermore, if the reservoir 13 is eliminated, the space of the reservoir 13 may be used to enlarge the water jacket 14. This would increase the efficiency of heat exchange between the heating chamber 7 and the coolant in the water jacket 14.

The electromagnetic clutch 17 may be eliminated from the structure of the viscous fluid heater. In this case, the pulley 19 in supported by the drive shaft 8 to rotate the pulley 19 integrally with the drive shaft 8. The pulley 19 transmits the drive force of the engine directly to the drive shaft 8.

Any type of media that produces fluid friction when sheared by a rotor and generates heat may be used as the viscous fluid. Thus, the viscous fluid 15 not limited to high viscosity fluid or semi-fluids such as silicone oil.

Therefore, the present examples and embodiments are to be considered as illustrative and not restrictive and the invention is not to be limited to the details given herein, but may be modified within the cope of the appended claims.

What is claimed is:

1. A viscous fluid type heater comprising:

a heating chamber containing viscous fluid, the heating chamber having a first wall;

a rotor located in the heating chamber, wherein the rotor is rotated by a drive shaft to shear the viscous fluid and produce heat in the heating chamber, therein the rotor has a first surface facing the first wall, wherein the first rotor surface and the first wall are spaced apart by a predetermined distance, and wherein some of the viscous fluid occupies the space between the first rotor surface and the first wall and is sheared when the rotor is rotated;

a heat exchange chamber located clone to the heating chamber, wherein the heat exchange chamber communicates with a coolant circuit, and heat generated by the fluid shearing is transmitted from the heating chamber to the coolant in the heat exchange chamber to heat the coolant in the fluid circuit; and a support shaft supporting the rotor, the support shaft being eccentrically coupled to the drive shaft.

2. The heater as set forth in claim 1, wherein the rotor has a peripheral surface, wherein the heating chamber has an inner peripheral wall, and wherein the peripheral rotor surface and the inner peripheral wall are spaced apart by a distance that varies in size according to the rotation of the rotor.

3. The heater as set forth in claim 2, wherein the space between the first rotor surface and the first wall is a first gap, and the space between the inner peripheral wall and the peripheral rotor surface is a second gap, and wherein the viscous fluid is forced to move between the first gap and the second gap due to the changing size of the second gap when the rotor rotates.

4. The heater as set forth in claim 3, wherein the rotor has a large diameter portion and a small diameter portion, and the heating chamber has a large diameter portion and a small diameter portion in general conformity with the rotor.

5. The heater as set forth in claim 4, wherein the peripheral rotor surface is part of the large diameter portion of the rotor, and wherein the inner peripheral wall is part of the large diameter portion of the heating chamber.

6. The heater as set forth in claim 5, wherein the small diameter portion of the rotor has a small outer peripheral surface, the small diameter portion of the heating chamber has a small inner peripheral wall, and the small outer surface and the small inner peripheral wall are spaced apart by a distance that varies like the second gap.

7. The heater as set forth in claim 1, wherein the heating chamber has a second wall, which is opposite to the first wall, wherein the rotor has a second surface facing the second wall such that the second rotor surface and second wall are spaced apart by a predetermined distance, which is approximately the same as that between the first rotor surface and the first wall, and wherein some of the viscous fluid occupies the space between the second wall and the second rotor surface and is sheared when the rotor rotates.

8. The heater as set forth in claim 1, further comprising:

a reserving chamber for reserving viscous fluid; and a passage connecting the reserving chamber with the heating chamber to permit the viscous fluid to move between the reserving chamber and the heating chamber.

9. The heater as set forth in claim 8, further comprising a valve for selectively opening and closing the passage based on the temperature of the viscous fluid.

10. The heater as set forth in claim 9, wherein the valve is formed of one of a shape memory alloy and a bimetal.

11. The heater as set forth in claim 8, wherein the heat exchange chamber is located closely adjacent to the first wall.

12. The heater as set forth in claim 1, wherein the rotor includes a recess formed in its outer surface for improving the shearing of the viscous fluid.

13. The heater according to claim 12, wherein the recess is a groove formed in the rotor.

14. The heater according to claim 12, wherein the recess is a hole bored in the rotor.

15. A viscous fluid type heater for heating a passenger compartment of a vehicle, the heater comprising:

a heating chamber containing viscous fluid, the heating chamber having a rear wall and a peripheral wall;

a rotor located in the heating chamber, wherein the rotor is rotated by a drive shaft to shear the viscous fluid and produce heat in the heating chamber, wherein the rotor has a peripheral surface and a rear surface, wherein the rear rotor surface faces the rear wall and the peripheral rotor surface faces the peripheral wall, wherein the rear rotor surface and the rear wall are spaced apart by a predetermined distance, and the peripheral rotor surface and the inner peripheral wall are spaced apart by a distance that varies in size according to the rotation of the rotor, and wherein some of the viscous fluid occupies the space between the rear rotor surface and the rear wall and is sheared when the rotor is rotated;

a heat exchange chamber located close to the heating chamber, wherein the heat exchange chamber communicates with a coolant circuit, and heat generated by the fluid shearing is transmitted from the heating chamber to the coolant in the heat exchange chamber to heat the coolant in the fluid circuit; and a support shaft supporting the rotor, the support shaft being eccentrically coupled to the drive shaft.

16. The heater as set forth in claim 15, further comprising:

a reserving chamber for reserving viscous fluid; and a passage connecting the reserving chamber with the heating chamber to permit the viscous fluid to move between the reserving chamber and the heating chamber.

17. The heater as set forth in claim 16, further comprising a valve for selectively opening and closing the passage based on the temperature of the viscous fluid.

18. The heater as set forth in claim 17, wherein the valve is formed of one of a shape memory alloy and a bimetal.

19. The heater as set forth in claim 15, wherein the heat exchange chamber is located closely adjacent to the rear wall.

20. The heater as set forth in claim 15, wherein the rotor includes a recess for improving the shearing of the viscous fluid.

21. The heater according to claim 20, wherein the recess is a groove formed in the rotor.

22. The heater according to claim 20, wherein the recess is a hole bored in the rotor.

* * * * *

UNITED STATES PATENT AND TRADEMARK OFFICE

CERTIFICATE OF CORRECTION

PATENT NO. : 5,809,992
DATED : September 22, 1998
INVENTOR(S) : Moroi et al.

It is certified that error appears in the above-identified patent and that said Letters Patent is hereby corrected as shown below:

Col. 2, line 28, after " line" delete the period " ." ;

line 58, change " Is" to - -is- -.

Col. 3, line 19, change " Sa" to - -8a- -.

Col. 4, line 8, change " 9" to - -8- -; same line, change " tho" to - -the- -.

Col. 5, line 21, change " fine" to - -fins- -;

UNITED STATES PATENT AND TRADEMARK OFFICE

CERTIFICATE OF CORRECTION

PATENT NO. : 5,809,992

DATED : September 22, 1998

INVENTOR(S) : Moroi et al.

It is certified that error appears in the above-identified patent and that said Letters Patent is hereby corrected as shown below:

Col. 5, line 40, after " oil" change " P" to - -F- -.

Col. 6, line 12, change " an" to - -as- -;

line 64, after " value" change " ,," to a comma " ," .

Col. 7, line 46, change " gap a" to --gap δ-.

Col. 9, line 19, change " 15" to - -is- -;

line 24, change " cope" to - -scope- -;

line 39, change " clone" to - -close- -.

Signed and Sealed this

Eleventh Day of May, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,809,992

DATED : September 22, 1998

INVENTOR(S) : MOROI et al.

It is certified that error appears in the above-identified patent and that said Letters Patent is hereby corrected as shown below:

On the cover page, column 1, after " [22]" and before " [51]" , insert:

--[30] Foreign Application Priority Data

Nov. 28, 1996 [JP] Japan 8-317994--.

Signed and Sealed this

Twentieth Day of July, 1999

*Attest:*

Q. TODD DICKINSON

*Attesting Officer*

*Acting Commissioner of Patents and Trademarks*